United States Patent [19]

Kiuchi et al.

[11] 4,356,371

[45] Oct. 26, 1982

[54] SMALL LOAD DETECTION BY COMPARISON BETWEEN INPUT AND OUTPUT PARAMETERS OF AN INDUCTION HEAT COOKING APPARATUS

[75] Inventors: Mitsuyuki Kiuchi, Minoo; Takumi Mizukawa, Neyagawa; Hideyuki Kominami, Takatsuki; Kenji Hattori, Amagasaki, all of Japan

[73] Assignee: Matsushita Electric Industrial Company, Limited, Osaka, Japan

[21] Appl. No.: 205,861

[22] Filed: Nov. 10, 1980

[30] Foreign Application Priority Data

Nov. 12, 1979 [JP] Japan ..... 54-146893
Jan. 9, 1980 [JP] Japan ..... 55-1091

[51] Int. Cl.[3] ..... H05B 6/08; H05B 6/12

[52] U.S. Cl. ..... 219/10.77; 219/10.49 R; 363/97; 363/21; 323/277

[58] Field of Search ..... 219/10.49 R, 10.77, 219/497; 323/275, 276, 277, 300; 363/20, 21, 55, 56, 97, 131

[56] References Cited

U.S. PATENT DOCUMENTS

| | | | |
|---|---|---|---|
| 4,016,392 | 4/1977 | Kobayashi et al. | 219/10.49 R |
| 4,074,101 | 2/1978 | Kiuchi et al. | 219/10.77 |
| 4,180,768 | 12/1979 | Ferraro | 323/278 |
| 4,183,082 | 1/1980 | Ishii | 323/275 X |
| 4,277,667 | 7/1981 | Kiuchi | 363/97 X |

FOREIGN PATENT DOCUMENTS

| | | | |
|---|---|---|---|
| 52-72952 | 6/1977 | Japan | 219/10.77 |
| 54-2525 | 1/1979 | Japan | 219/10.49 R |

*Primary Examiner*—B. A. Reynolds
*Assistant Examiner*—Philip H. Leung
*Attorney, Agent, or Firm*—Lowe, King, Price & Becker

[57] ABSTRACT

An induction heat cooking apparatus includes an inverter which generates ultrasonic frequency energy for heating a magnetic load by induction, and a small load detection circuit. The detection circuit includes a comparator which compares the input and output parameters of the inverter and latches a bistable device when the input power is smaller than the output parameter. The bistable device shuts down the inverter to prevent inadvertently placed small utensil objects from being excessively heated.

11 Claims, 8 Drawing Figures

SMALL LOAD DETECTION BY COMPARISON BETWEEN INPUT AND OUTPUT PARAMETERS OF AN INDUCTION HEAT COOKING APPARATUS

BACKGROUND OF THE INVENTION

The present invention relates generally to induction heating cooking apparatus, and in particular to a circuit for detecting inductive loads lower than a predetermined value to prevent inadvertently placed small utensil objects from being excessively heated.

In induction heat cooking, low frequency energy is converted to energy of ultrasonic frequency by a solid-state inverter which includes a tank circuit formed by a heating coil and a capacitor. Because of the invisibility of the inductive coupling between the coil and an inductive load to the eyes of the user, small utensil objects such as spoons, knives or forks may carelessly be placed over the heating coil and excessively heated. As a safeguard against possible injury which might otherwise occur as the user attempts to remove the heated objects, load detection circuits have hitherto been proposed. In a load detection circuit as exemplified by the system shown and described in U.S. Pat. No. 3,823,297, the input power of the inverter is compared with a reference d.c. level to determine whether the load is lower than a predetermined value. If the input power is lower than the reference level, the inverter is shut down intermittently to significantly reduce the heat generated in the load. The aforesaid U.S. patent also discloses a detection circuit in which the output power of the inverter is compared with a reference d.c. level to detect such low load condition. A similar approach is also disclosed in U.S. Pat. No. 4,016,392 in which a voltage sensor is coupled to the tank circuit of the inverter to reduce the heat generated in the load.

The load detection circuits as disclosed in the aforesaid U.S. patents are only useful for induction heating in which the output frequency of the inverter is maintained constant. If the disclosed detection circuits are employed in conjunction with an induction heating apparatus in which heating power level is controlled by varying the inverter output frequency according to a power setting level, difficulty is encountered in discriminating between normal load and small utensil objects when the power setting level is adjusted to a low level since there is no significant difference between the input power associated with normal load and that associated with low or no load. This is true for the voltages developed in the heating coil, in association with different loads.

In the prior art frequency-controlled inverter the inverter frequency is varied as a function of power setting level, so that for a minimum power setting level the inverter frequency is lowered to a level below the inaudible frequency limit. This frequency limit thus sets the minimum power setting level to a relatively high value, which increases the difficulty in determining small utensil objects.

SUMMARY OF THE INVENTION

The primary object of the present invention is therefore to provide a detection circuit which allows determination of small inverter load with distinction even though the power setting level of induction heating is reduced to a minimum.

The present invention is based on the discovery that there is a predeterminable relationship between the input power and an output electrical parameter of the inverter which represents the reverse current component of the high frequency oscillation. This relationship indicates that when the input power is lower than the output parameter it can be distinctively determined that the load is lower than a predetermined value.

The present invention thus contemplates to make a comparison between the inverter input power and its electrical output parameter. The result of this comparison is utilized to shut off the inverter as long as the input power is lower than the output parameter. This method of comparison is advantageously employed in an induction heating apparatus which includes means for controlling the inverter frequency in a feedback mode so that the input power is maintained at a desired power setting level. This is due to the fact that since the input power is maintained constant for a given power setting level, the relationship between the input and output parameters is determined distinctively regardless of the load level.

Moreover, it is further advantageous to control the inverter frequency as an inverse function of power setting, whereby, at a minimum power setting level, the inverter frequency is brought to a frequency value much higher than the inaudible frequency limit so that the lower end of power control range can be extended down to a level lower than is available with the prior art.

The electrical output parameter may be derived from any appropriate point of the inverter in so far as it represents the reverse current component of inverter oscillation which in turn contributes to negative power that is advantageously returned to the input side of the inverter for power savings. Such parameter includes a voltage developed in the inverter switching device, or current or voltage generated in the inverter heating coil.

BRIEF DESCRIPTION OF THE DRAWINGS

The invention will be further described by way of example with reference to the accompanying drawings, in which.

DETAILED DESCTIPTION

Figure 1:
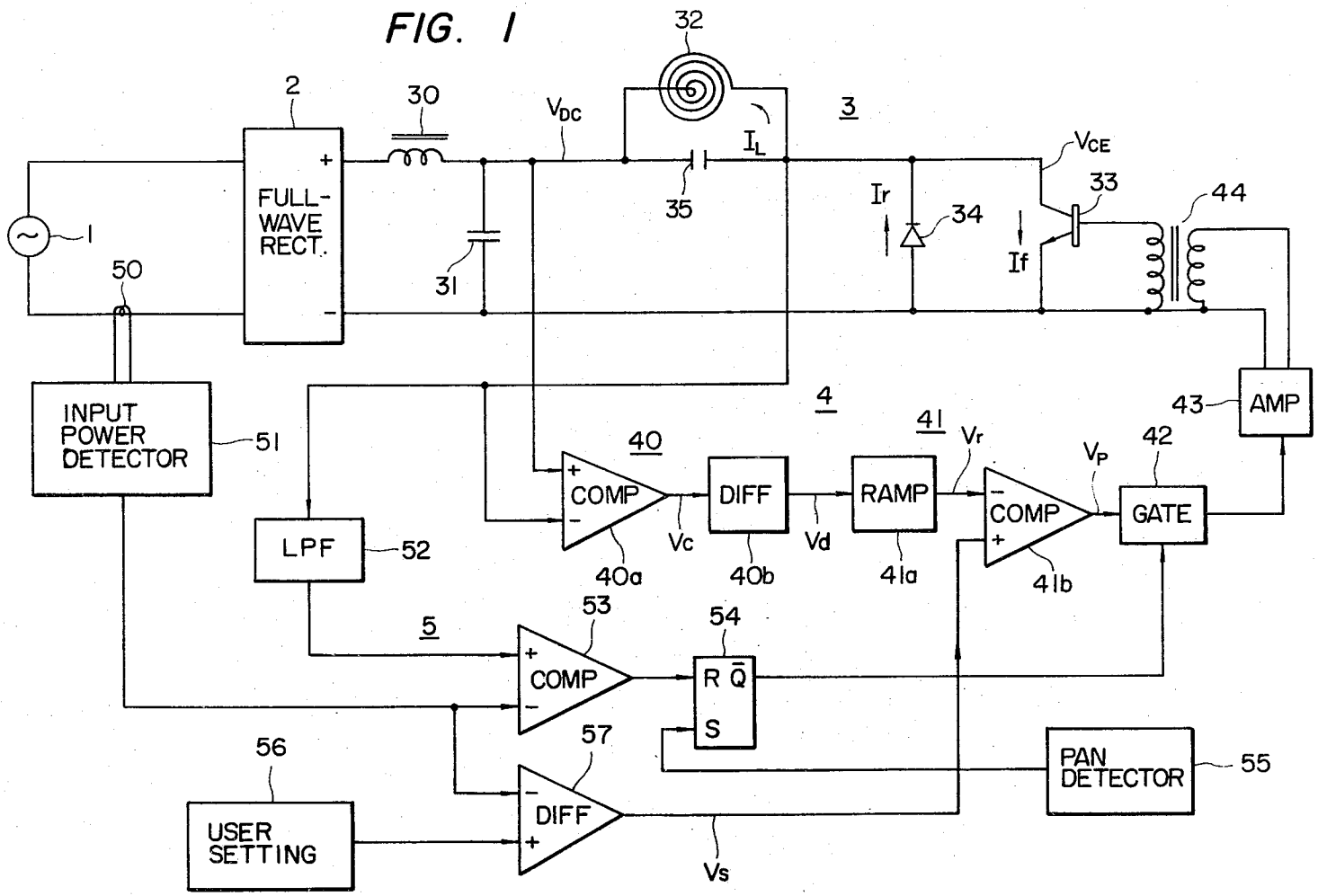
FIG. 1 is a block diagram of an induction heating cooking apparatus of the present invention.

Referring now to FIG. 1, an induction heating cooking apparatus of the invention is illustrated. Low frequency energy from an alternating current source 1 is converted into a full-wave recitifed unfiltered voltage by a full-wave rectifier 2 and applied to an inverter circuit 3. The inverter 3 includes a power-rated switching transistor 33 and a damping diode 34 connected in anti-parallel with the transistor 33. The collector of transistor 33 is connected through an induction heating coil 32 and through a filter inductor 30 to the positive terminal of the rectifier 2, the emitter of transistor 33 being connected to the negative terminal of rectifier 2. The heating coil 32 is in shunt with a resonating capacitor 35. The base of transistor 33 is connected to the secondary winding of a pulse transformer 44 which receives a base drive pulse for the transistor 33 from the gating control circuit detailed below to cause the transistor 33 to turn on and off at a variable repetition frequency to be described. The switching operation of the transistor 33 produces a high frequency current in the heating coil 32 through a feedback control circuit 4. The high frequency current is passed through a low impedance path provided by a filter capacitor 31.

The voltage developed at the high frequency end of the inductor 30 is considered substantially as a d.c. voltage as compared with the high frequency current generated in the inverter 3. This d.c. voltage is applied to a reference crossing point detector 40 which includes a comparator **40*a* and a differentiator 40*b*. The comparator 40*a* receives the d.c. voltage at its positive or noninverting input for making a comparison with the collector-emitter voltage $V_{CE}$ (hereinafter called collector voltage) of the switching transistor 33 which is applied to the negative or inverting input of comparator 40*a*. The output of this comparator is driven to a high level when the d.c. voltage becomes higher than the collector voltage, the comparator output being coupled to differentiator circuit 40*b*** to generate a negative going pulse in response to each positive transition of the comparator output.

A pulse width modulator 41 is provided which includes a ramp generator **41*a* and a comparator 41*b*. This ramp generator receives its trigger pulse from the output of differentiator 40*b* to generate a ramp voltage which is applied to the inverting input of the comparator 41*b* for making a comparison with a variable reference d.c. voltage which is applied from a differential amplifier 57 whose function will be described later. The output of the comparator 41*b* is connected via an inhibit gate 42 to an amplifier 43 and thence to the primary winding of the transformer 44 to drive the switching transistor 33. Thus, in the absence of an inhibit signal applied to the gate 42, the transistor 33 is provided with base trigger pulses to generate high frequency currents in the induction heating coil 32** which is located beneath the cooking surface of the apparatus for inductively heating a vessel placed thereon.

In accordance with the invention, a low load detector circuit 5 includes an input current detecting transformer 50 inductively coupled to the power input circuit between the low frequency source 1 and full-wave rectifier 2. An input power detector 51 is connected to the transformer 50 to generate a d.c. voltage representative of the power supplied to the inverter 3. This input power indicating d.c. voltage is applied to the inverting input of a comparator 53 for making a comparison with an electrical parameter of the inverter 3 which represents the negative output power that is generated in response to the reverse current component of the inverter oscillation. This parameter is derived from any appropriate point of the inverter. In one example, the collector voltage of transistor 33 is considered appropriate for this purpose. To this end a lowpass filter 52 is connected to the collector of transistor 33 to supply the noninverting input of comparator 53 with a d.c. voltage corresponding to the collector voltage. The output of the comparator 53 is high when the output parameter of the inverter 3 is higher than the input power. This condition will occur when the inverter load is lower than a minimum pan load indicating the presence of an abnormally small inverter load or no load.

The output of comparator 53 is applied to the reset input of a flip-flop 54 which generates a high complementary output to the control terminal of the inhibit gate 42. With the inhibit pulse being supplied to the gate 42, inverter operation is shut off to prevent inadvertently placed small utensil from being heated excessively. Inverter operation is resumed when the flip-flop 54 is triggered into set condition in response to an output from a normal pan load detector 55. An appropriate type of this pan load detector is disclosed in U.S. Pat. No. 3,993,885 assigned to the assignee of this invention.

A user setting circuit 56 provides a setting voltage indicative of a desired power level to the noninverting input of differential amplifier 57 for making a comparison with the input power signal from the detector 51 to generate an error signal representative of the amount of deviation of the input power from the power setting. The error signal is used as the variable reference level for the comparator **41*b* so that it generates a train of pulses having a duration that is a function of the power setting value. Thus, the repetition frequency of the base drive pulse supplied to the transistor 33** is inversely proportional to the power setting.

Figure 2:
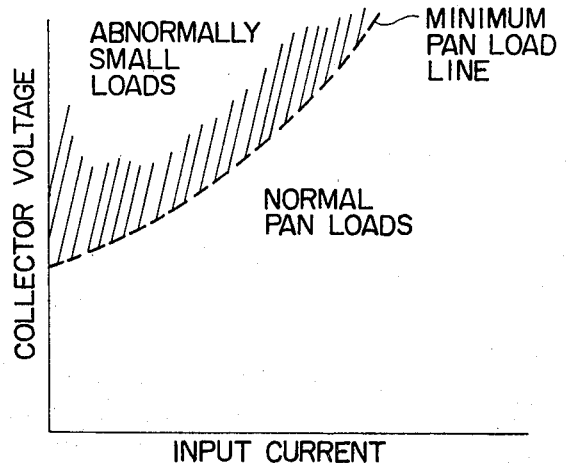
FIG. 2 is a graphic illustration of the relationship between inverter input power and the voltage developed in the switching device of FIG. 1.

Because of the feedback operation of the circuit 4, the input power detected by detector 51 is automatically adjusted to the user setting value regardless of the size of inverter load. FIG. 2 is a graphic illustration of the collector voltage versus input current relationship of the circuit of FIG. 1. As shown the collector voltage varies nonlinearly as a function of the input current. When the inverter load is relatively large the collector voltage adopts a curve which lies below the minimum pan load line. Whereas, under no load or low load conditions, the collector voltage adopts a curve which lies above the minimum pan load line. Therefore, under normal load conditions, the collector voltage is lower than the voltage from the input detector 51, thus resulting in a low level output from the comparator 53. Conversely, under no load or low load conditions the collector voltage becomes higher than the output of the detector 51, so that a high level comparator output results to shut off the inverter operation. Load size discrimination is thus achieved over the full range of power setting values.

The aforesaid inversely proportional relationship between the power setting value and inverter frequency is advantageous in that it brings down the lower limit of power control range to a very low level due to the fact that for a minimum power setting the inverter frequency is brought up to as high as 50 kHz which is well above the inaudible frequency limit. Otherwise, the inverter frequency would be brought down to a level below the inaudible limit, which inevitably sets the lower setting to a relatively high level. This reduction of the lower limit of power control range permits the comparator 53 to detect the presence of small objects even though the power setting is reduced to a considerable low level at which such small objects cannot be detected by conventional low load detectors.

Figure 3:
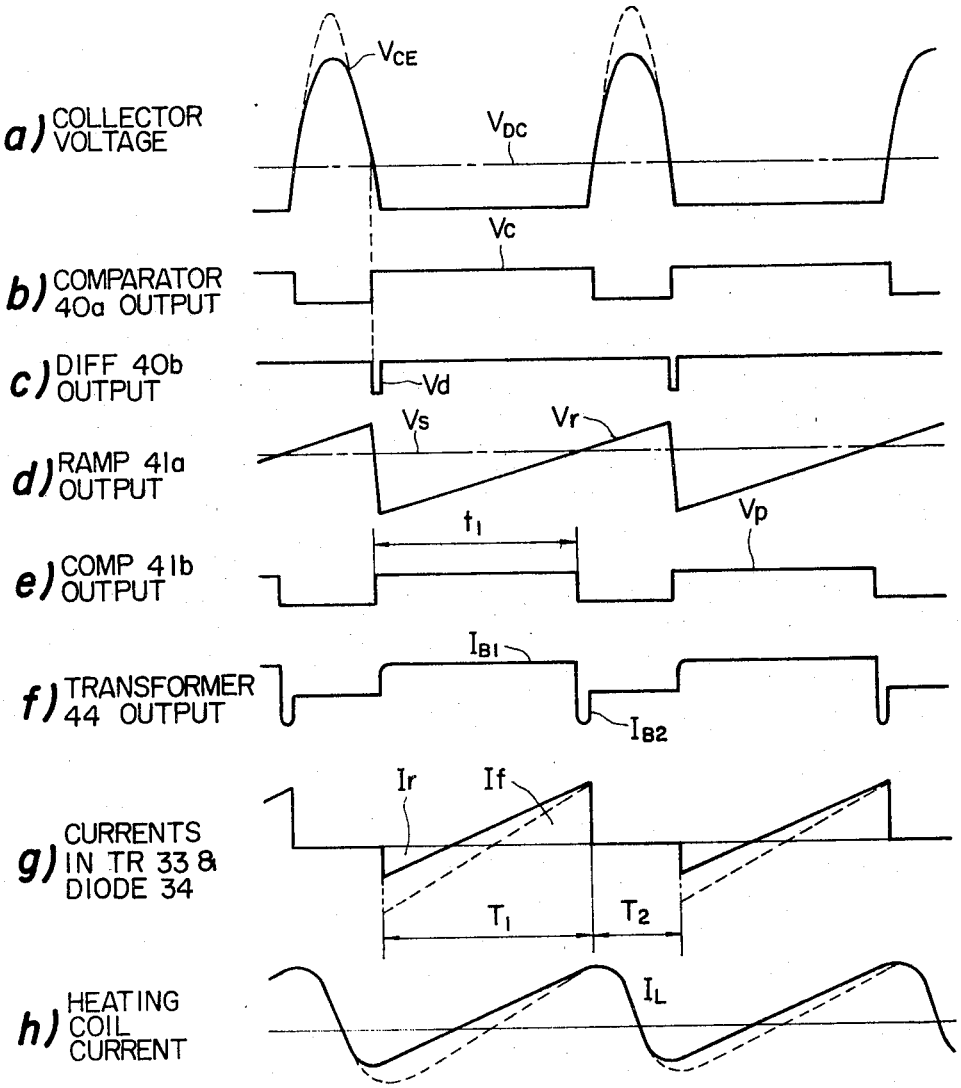
FIGS. 3*a* to 3*h* are a waveform diagram associated with the embodiment of FIG. 1 when the inverter is operated at a maximum power setting.
Figure 4:
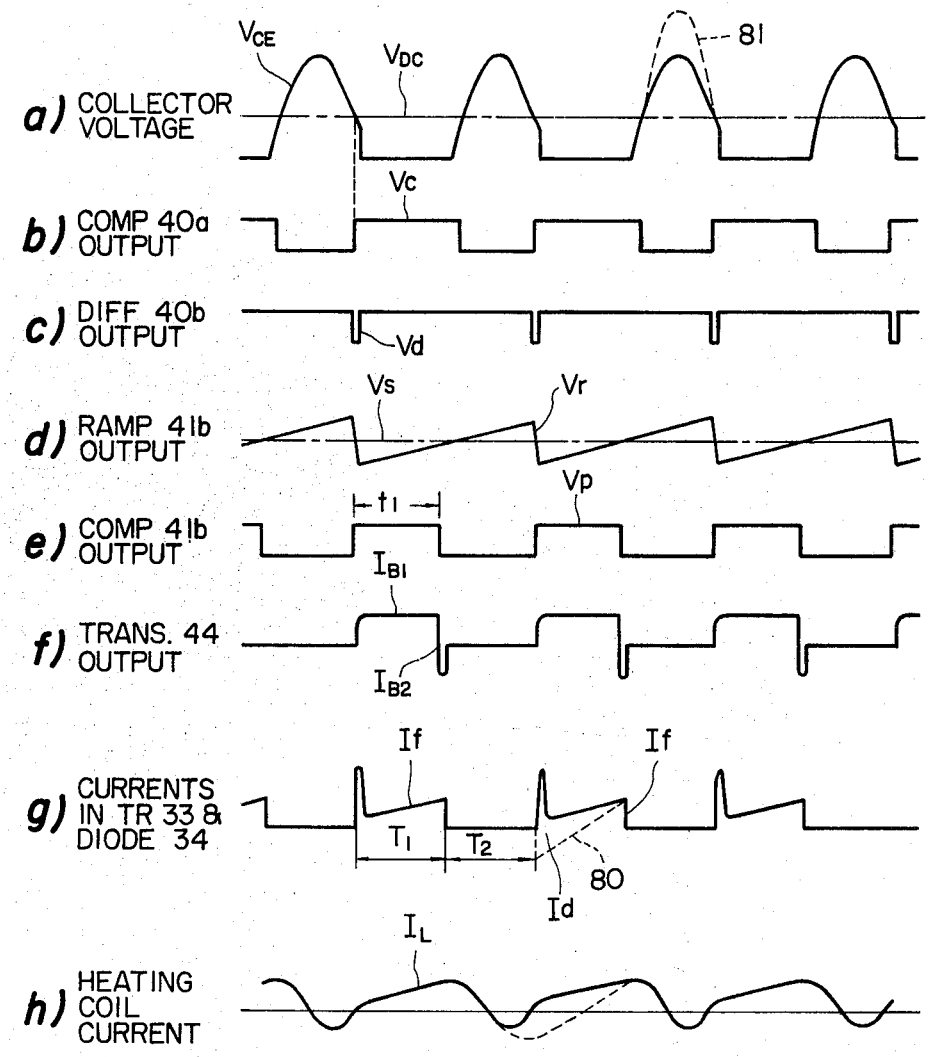
FIGS. 4*a* to 4*h* are a waveform diagram associated with the FIG. 1 embodiment when the power setting is at a minimum.

Details of the feedback inverter operation will now be described with reference to waveform diagrams shown in FIGS. 3 and 4. The waveforms shown in FIG. 3 are those which are generated when the apparatus is operated at a maximum power setting. When the inverter operates under normal pan load, the collector voltage $V_{CE}$ assumes a waveform indicated by a solid line in FIG. 3*a* having halfwave pulses higher than the reference d.c. voltage $V_{DC}$ at the output of the inductor 30. The output of the comparator 40*a* is a train of rectangular pulses with an amplitude Vc (FIG. 3*b*) which appear when the collector voltage falls below the reference voltage $V_{DC}$. The output Vd of the differentiator l 40*b*, shown in FIG. 3*c*, triggers the ramp generator 41*a* to generate a ramp voltage Vr (FIG. 3*d*) which is compared with the power control reference voltage Vs. FIG. 3*e* shows the output of comparator 41*b* which is a train of rectangular pulses having a pulse duration that is a function of the power control voltage Vs. Since the apparatus is assumed to be operated under maximum power setting, the pulse duration $t_1$ is at a maximum. The primary winding of transformer 44 is excited by the output of the comparator 41*b* after amplification at 43. This results in a positive current $I_{B1}$ in the secondary winding that drives the switching transistor 33 into conduction (FIG. 3*f*). A negative current $I_{B2}$ is generated in response to the negative transition of the positive current by the counter-electromotive action of the transformer 44. The transistor 33 is turned off by the negative current. During the period when transistor 33 is turned on the collector voltage $V_{CE}$ is at a minimum which is below the reference voltage $V_{DC}$. Upon the turn-off of transistor 33, the collector voltage rises, generating a sinusoidal halfwave pulse. The duration of this halfwave pulse is primarily determined by the resonant frequency of the resonant circuit formed by heating coil 32 and capacitor 35. FIG. 3*g* shows the current waveforms produced in the transistor 33 and diode 34. When the halfwave pulse is generated at the collector of transistor 33, the capacitor 35 is charged. The stored energy is then discharged in response to the termination of the halfwave collector voltage through the diode 34 generating therein a reverse current $I_r$. This causes the resonating circuit to oscillate to generate a forward current $I_f$ in the transistor 33. As a result the current $I_L$ shown in FIG. 3*h* is produced in the heating coil 32. Since the reverse current $I_r$ is negative with respect to the d.c. voltage supplied to the inverter, this represents the negative power that is returned to the input circuit of the apparatus, thus contributing to power savings.

When the apparatus is operated under small load conditions provided that the power setting remains unchanged, the peak value of the collector voltage $V_{CE}$ increases as indicated by the broken line in FIG. 3*a*. The current $I_r$ also increases as shown in broken line in FIG. 3*g* since the feedback circuit 4 tends to maintain the high frequency output to the user's power setting level.

The amount of power delivered to the load is proportional to the duty cycle ratio $T_1/(T_1+T_2)$ which reaches a maximum value when the power setting is maximum, and the inverter frequency is at a minimum which is typically 20 kHz.

Since the heating coil 32 and capacitor 35 are tuned substantially to a constant frequency, the duration of the halfwave collector voltage is substantially constant regardless of the size of inverter loads. When the power setting is reduced to a minimum, the conduction period $t_1$ of transistor 33 is accordingly by reduced as illustrated in FIG. 4*e*. As a result, the duty cycle ratio is reduced as shown in FIG. 4*g*, and the inverter frequency reaches a maximum which is typically 50 kHz.

With the power setting maintained at a minimum level, normal inverter loading will cause the electromagnetic energy of the inverter to be consumed in the heating coil 32 with the result that there is a decrease in the forward current $I_f$ in the transistor 33 and there is no reverse current $I_r$ in the diode 34 as shown in FIG. 4*g*. However, if the inverter load is decreased considerably a reverse current $I_r$ is produced in the diode 34 as indicated by a broken line 80 in FIG. 4*g*. As a result the collector voltage $V_{CE}$ assumes a high peak value as indicated by a broken line 81 in FIG. 4*a*, and the reverse current in the heating coil 32 also increases due to the action of the feedback circuit 4, as shown in FIG. 4*h*.

Figure 6:
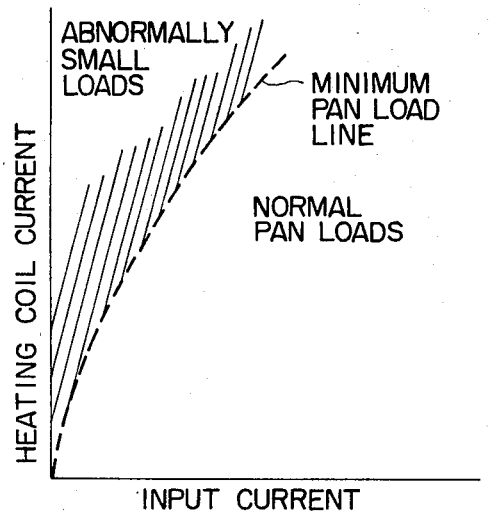
FIG. 6 is a graphical illustration of the relationship between inverter input power and the current generated in the heating coil of FIG. 5.
Figure 5:
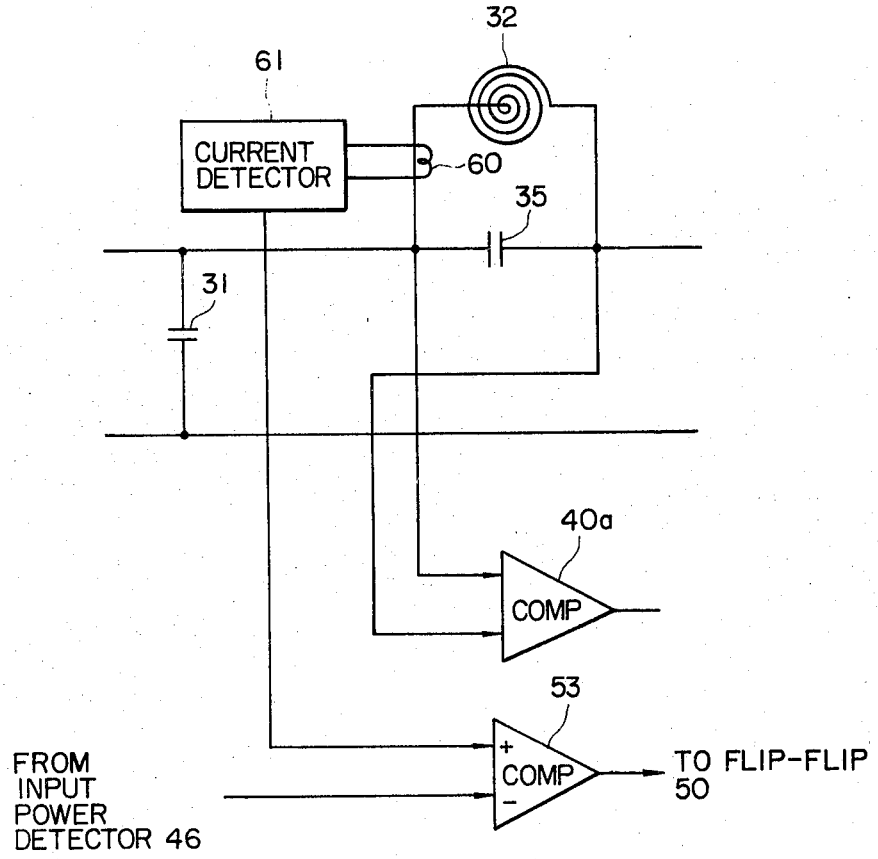
FIG. 5 is a modified form of the embodiment of FIG. 1.

In FIG. 5, the output electrical parameter is represented by a current flow in the heating coil 32 as detected by a current transformer 60. Transformer 60 is coupled to a current detector 61, which essentially comprises a low-pass filter. The detector 61 converts the detected current into a corresponding voltage which is applied to the noninverting input of comparator 53. FIG. 6 graphically represents the relationship between the input current and the heating coil current.

Figure 7:
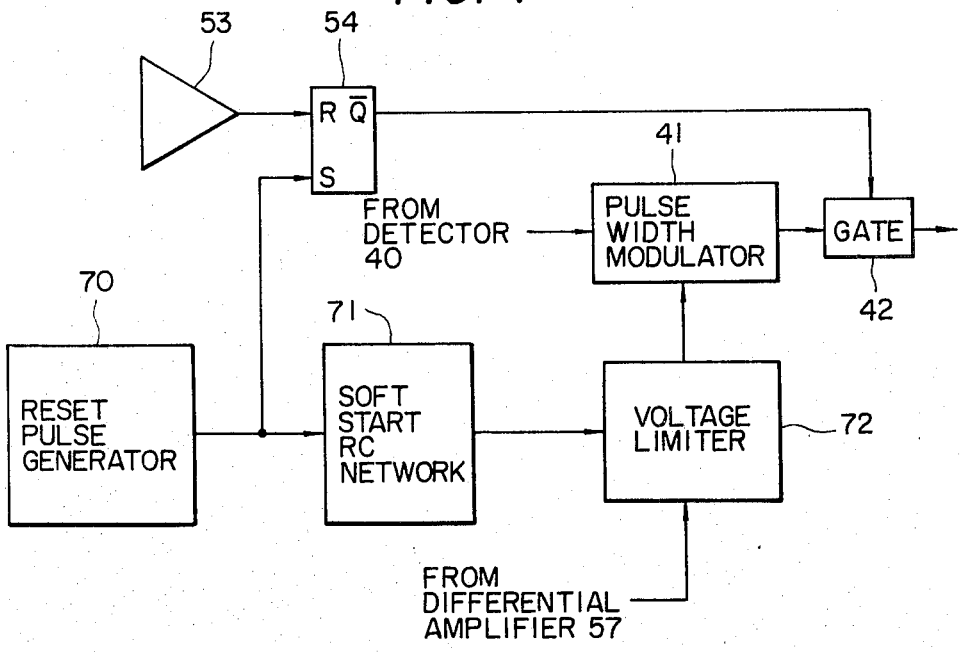
FIG. 7 is a modified form of the pan detector of FIG. 1.
Figure 8:
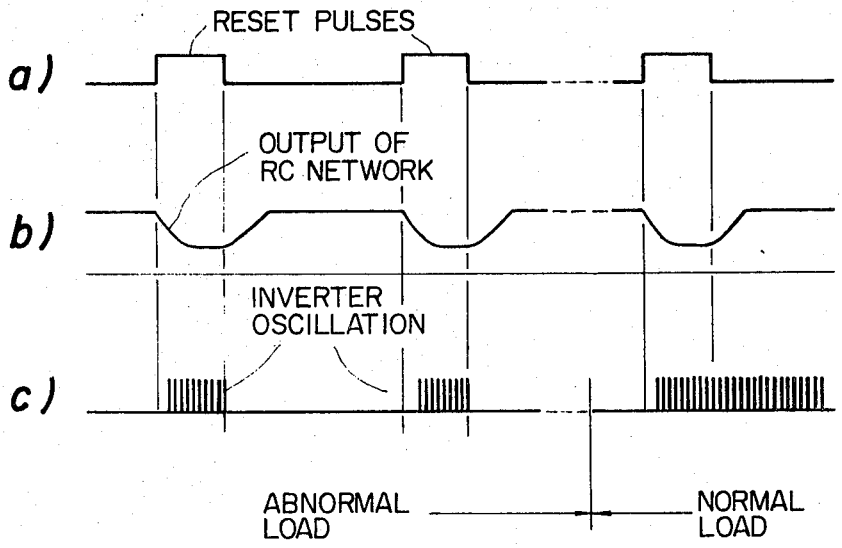
FIGS. 8*a* to 8*c* are a waveform diagram associated with the circuit of FIG. 7.

The embodiment of FIG. 1 may be modified as shown in FIG. 7 in which the inverter 3 resumes normal operation in response to a reset pulse supplied from a reset pulse generator 70. The reset pulse generator 70 provides a pulse of a predetermined duration at a constant frequency to the set input of flip-flop 54 and to a soft start resistor-capacitor network 71 whose output is coupled to a control input of a voltage limiter 72 which takes its input from the output of differential amplifier 57. The operation of this embodiment will be described with reference to FIG. 8.

In response to the leading edge transition of a reset pulse the RC network 71 generates a gradually voltage (FIGS. 8*a* and 8*b*) which causes the limiter 72 to gradually modify the output Vs of the differential amplifier 57 from a minimum to a maximum value. Thus, the pulse width of the pulses applied to the transistor 33 is varied from a minimum to a maximum value, so that the inverter is "soft" started. This avoids the occurrence of a surge current which would be generated if the transistor 33 were biased into conduction by a pulse of relatively wide width at the instant the inverter operation is reinitiated. As long as the inverter load is lower than the minimum pan load, the inverter is reinitiated in response to each reset pulse and shut down in response to the output of the comparator 53 as the latter detects the presence of such inverter loads. Thus the inverter is intermittently operated in response to each reset pulse as illustrated in FIG. 8*c* until, normal pan load is placed over the cooking surface.

In response to the placement of a normal pan load, the inverter is reinitiated. This condition continues since the inverter is not inhibited again due to a low level output provided by the comparator 53. Thus, the reset pulse serves as a search signal for detecting whether the small utensil object is replaced with a normal pan load.

Various modifications are apparent to those having the ordinarlly skill in the art of induction heating without departing from the scope of the invention which is only limited by the appended claims. For example, the transistor 33 may be replaced with a gate turnoff thyristor, or the inverter may be constructed by a normal thyristor in conjunction with the commutation circuit formed by a heating coil and a commutation capacitor which commutates through a feedback diode. Furthermore, the apparatus may comprise a cycloconverter in which at least one pair of anti-parallel connected thyristors is connected to a low frequency alternating current source.

What is claimed is:

1. An induction heat cooking apparatus comprising:
a semiconductor power-rated switching device,
a resonant circuit formed by an induction heating coil and a capacitor means for converting a low frequency input into a high frequency output in response to the conduction of said semiconductor power-rated switching device and for heating an inductive load placed in overlying relation with said heating coil,
an input detector means for sensing said low frequency input,
an output detector means for sensing said high frequency output,
reference means for generating a reference voltage corresponding to a user's power setting level,
a feedback circuit including:
a reference crosspoint detector means for sensing when said high frequency output reaches a predetermined voltage level, and
a pulse-width modulated pulse generator means responsive to the output of said reference crosspoint detector means for generating a gating pulse having a duration which is a function of said reference voltage for gating said switching device into conduction thereby controlling the power level of said high frequency output to tend toward said power setting level and to attain a high value in comparison with said low frequency input when said inductive load is lower than a predetermined value, and
a comparator means for comparing the outputs of said input and output detector means to generate a comparator output when the sensed high frequency output is greater in magnitude than the sensed low frequency input, and
means for inhibiting said apparatus in response to said comparator output.

2. An induction heat cooking apparatus as claimed in claim 1, wherein said pulse-width modulated pulsed generator means comprises a ramp generator means connected to said reference crosspoint detector means for generating a ramp voltage and a second comparator means for comparing the instantaneous value of said ramp voltage with said reference voltage for generating as said gating pulse a rectangular pulse having a duration which is a function of said power setting level for application to said power-rated switching device.

3. An induction heat cooking apparatus as claimed in claim 2, wherein said means for generating a reference voltage comprises a differential amplifier means for detecting the difference between said power setting level and the output of said input detector means, the output of said differential amplifier means being applied to said second comparator means as said reference voltage.

4. An induction heat cooking apparatus as claimed in claim 1, 2 or 3, wherein said output detector means is connected to said semiconductor power-rated switching device.

5. An induction heat cooking apparatus as claimed in claim 1, 2 or 3, wherein said output detector means is connected to said induction heating coil to detect the current flowing therein.

6. An induction heat cooking apparatus as claimed in claim 1, 2 or 3, further comprising a latching circuit means responsive to the output of the first-mentioned comparator means for inhibiting said apparatus and an unlatching circuit means for detecting when said inductive load is greater than said predetermined value to unlatch said latching circuit means.

7. An induction heat cooking apparatus as claimed in claim 6, wherein said unlatching circuit means comprises a pan load detector for detecting the presence of a magnetic pan load of a normal size placed over said heating coil.

8. An induction heat cooking apparatus as claimed in claim 1, 2 or 3, further comprising a latching circuit means responsive to the output of the first-mentioned comparator means for inhibiting said apparatus and a second pulse generator means for repeatedly unlatching said latching circuit means.

9. An induction heat cooking apparatus as claimed in claim 8, further comprising means for causing said reference voltage applied to said second comparator means to increase gradually in response to an output of said second pulse generator means.

10. An induction heat cooking apparatus as claimed in claim 1, wherein said output detector means comprises a low-pass filter.

11. An induction heat cooking apparatus as claimed in claim 1, wherein said reference crosspoint detector means comprises a third comparator means having first and second input terminals coupled across said induction heating coil and a differentiator means coupled to the output of said third comparator means for generating a trigger pulse for application to said pulse-width modulated pulse generator means.

* * * * *